US009041634B2

(12) United States Patent
Wu

(10) Patent No.: US 9,041,634 B2
(45) Date of Patent: May 26, 2015

(54) PIXEL STRUCTURE OF ORGANIC LIGHT EMITTING DIODE AND DRIVING METHOD THEREOF

(75) Inventor: Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 266 days.

(21) Appl. No.: 13/703,853

(22) PCT Filed: Sep. 12, 2012

(86) PCT No.: PCT/CN2012/081304

§ 371 (c)(1), (2), (4) Date: Dec. 12, 2012

(87) PCT Pub. No.: WO2013/037295

PCT Pub. Date: Mar. 21, 2013

(65) Prior Publication Data

US 2013/0293450 A1 Nov. 7, 2013

(30) Foreign Application Priority Data

Sep. 14, 2011 (CN) ..... 2011 1 0271117

(51) Int. Cl.
*G09G 3/32* (2006.01)
*G09G 3/02* (2006.01)

(52) U.S. Cl.
CPC ..... *G09G 3/02* (2013.01); *G09G 3/3233* (2013.01); *G09G 2300/0819* (2013.01); (Continued)

(58) Field of Classification Search
CPC . G09G 3/3208; G09G 3/3258; G09G 3/3233; G09G 2300/0439; G09G 2300/0866; G09G 2300/0842; G09G 2300/0861; G09G 2300/0819; G09G 2310/0251; G09G 2320/045; G09G 2320/0233; G09G 2320/043; G09G 2320/0223
See application file for complete search history.

(56) References Cited

U.S. PATENT DOCUMENTS

2006/0262051 A1* 11/2006 Kim et al. ..... 345/76
2007/0063932 A1* 3/2007 Nathan et al. ..... 345/76
(Continued)

FOREIGN PATENT DOCUMENTS

CN 1949342 A 4/2007
CN 101859542 A 10/2010
(Continued)

OTHER PUBLICATIONS

Korean Notice of Allowance Dated Jun. 26, 2014 Appln. No. 10-2012-7032679.
(Continued)

*Primary Examiner* — Lixi C Simpson
(74) *Attorney, Agent, or Firm* — Ladas & Parry LLP

(57) ABSTRACT

The present invention provides a pixel structure of an organic light emitting display device and driving method thereof. The pixel structure comprises first to fifth thin film transistors, a capacitor and an OLED device. Following steps are performed for the pixel structure in a refresh process of each frame of images: during a pre-charging period, the scan line and a first control signal (EM) are at a low level, a second control signal (EMD) is at a high level; during a compensation period, the scan line is at a low level, the first control signal (EM) and the second control signal (EMD) are at a high level; and during a light emitting period, the scan line is at a high level, the first control signal (EM) and the second control signal (EMD) are at a low level.

9 Claims, 5 Drawing Sheets

(a) Pre-charging (b) Compensating

(52) U.S. Cl.
CPC ..... *G09G 2300/0842* (2013.01); *G09G 2300/0861* (2013.01); *G09G 2320/0223* (2013.01); *G09G 2320/043* (2013.01); *G09G 2300/0866* (2013.01)

(56) References Cited

U.S. PATENT DOCUMENTS

| | | | |
|---|---|---|---|
| 2010/0127955 | A1 | 5/2010 | Choi |
| 2011/0050736 | A1 | 3/2011 | Fan et al. |
| 2011/0084947 | A1 | 4/2011 | Chung et al. |
| 2011/0095967 | A1 | 4/2011 | Choi |
| 2011/0122119 | A1 | 5/2011 | Bae et al. |

FOREIGN PATENT DOCUMENTS

| | | | |
|---|---|---|---|
| CN | 101996579 | A | 3/2011 |
| CN | 101996582 | A | 3/2011 |
| CN | 102651195 | A | 8/2012 |
| KR | 101030002 | B1 | 4/2011 |
| KR | 20110038393 | A | 4/2011 |

OTHER PUBLICATIONS

Extended European Search report Dated Mar. 12, 2014 Appln No. EP 12 79 5318.

First Chinese Office Action dated Nov. 8, 2013; Appln. No. 201110271117.X.

Korea Non-Final Office Action; dated Dec. 30, 2013; Appln. No. 10-2012-7032679.

International Preliminary Report on Patentability dated Mar. 18, 2014; PCT/CN2012/081304.

Jae-Hoon Lee, et al; "Current programming pixel circuit and data-driver design for active-matrix organic light-emitting diodes", Journal of the SID; vol. 12, Issue 3, pp. 227-231; Sep. 2004.

International Search Report mailed Jun. 12, 2012; PCT/CN2012/081304.

* cited by examiner (1) Pre-charging (2) Compensating (3) Emitting Light (a) Pre-charging (b) Compensating (c) EMITTING LIGHT

PIXEL STRUCTURE OF ORGANIC LIGHT EMITTING DIODE AND DRIVING METHOD THEREOF

CROSS REFERENCE TO RELATED APPLICATIONS

This application is a national stage application under 35 U.S.C. 371 and claims the benefit of PCT Application No. PCT/CN2012/08304 having an international filing date of Sep. 12, 2012, which designated the United States, which PCT application claimed the benefit of Chinese Application No. 201110271117.X filed Sep. 14, 2011, the disclosure of each of which are incorporated herein by reference.

FIELD OF THE INVENTION

The present invention relates to a pixel structure of organic light emitting display device and driving method thereof.

BACKGROUND

An Organic Light Emitting Display Diode (OLED), as a current-type light emitting device, has been applied to displays with high performance more widely. With an increasing in size of the display, the traditional passive matrix OLED requires shorter drive time for single pixel, and thus an instantaneous current has to be increased, which increases power consumption. Further, applying a large current would cause a voltage drop across ITO line too large and an operation voltage of the OLED too high, and in turn the efficiency of the OLED would decrease. Application of an Active Matrix OLED (AMOLED) device may settle such problem well, since it inputs OLED current by scanning line-by-line through switch transistors.

In designs for backboard of the AMOLED, a main problem to be settled is non-uniformity in brightness among pixels.

Firstly, most of the AMOLED constructs a pixel circuit by utilizing Low Temperature polycrystalline silicon Thin Film Transistor (LTPS TFT) so as to provide corresponding currents to the OLED devices. As compared with the general amorphous-Si TFT, the LTPS TFT has a higher mobility and a more steady character, and is more suitable for being applied in the AMOLED displays. However, the LTPS TFT formed on a glass substrate with a large area often has non-uniformity on electrical parameters such as threshold voltage, mobility, etc. due to a limitation in the crystallization process, and such non-uniformity will lead to a current difference and brightness difference of the OLED display devices which may be perceptible to human eyes, that is, a mura phenomenon occurs.

Secondly, in an application of displays with large size, power lines on the backboard have certain resistance and the driving currents in all of the pixels are provided by the ARVDD, therefore a voltage of power supply in areas near a power supplying position of the ARVDD is higher than that in areas far away from the power supplying position in the backboard. This phenomenon is called as resistance voltage drop (IR Drop). Because the voltage of the ARVDD is relevant to the current, the IR Drop also causes current differences in different areas, and in turn the mura would occur as display.

Thirdly, uneven thickness in the film, when the OLED device is evaporated, also may cause the non-uniformity in the electrical performances. Further, after operating for a long time, a degradation of its internal electrical performances may result in an increased threshold voltage, such that the efficiency of light emitting is low and brightness drops. As shown in FIG. 6(*a*), the brightness of the OLED device decreases, and its threshold voltage increases gradually, as the usage time increases.

How to compensate the degradation of the OLED device has been an important issue recently, because the degradation of the OLED may cause an occurrence of Image Sticking in areas displaying unchanged pictures for a long time, which affects the display effect.

As shown in FIGS. 6(*b*), 6(*c*), the increasing of the threshold voltage of OLED basically has a linear relationship with the brightness loss, and a relationship between the current of OLED and the brightness is also linear. Therefore, when the degradation of the OLED is compensated, we can increase the driving current linearly as the threshold voltage of OLED increases so as to compensate the brightness loss.

The AMOLED may be divided into three classes based on the driving mode: a digital type, a current type and a voltage type. The driving method of digital type realizes grayscale levels by using TFTs as switches to control a driving time without compensating the non-uniformity, but its operation frequency would increase doubly with an increasing of the display size, which results in a large amount of power consumption and would reach the physical limit of design in a certain range, therefore it is not suitable for applications with large display size. The driving method of current type realizes grayscale levels by providing different currents to the drive transistor directly, and it may compensate the non-uniformity of the TFTs and the IR drop well, however, a overlong written time would occur when a small current charges a large parasitic capacitance on the data line, and such problem is specially serious and difficult to be overcome in the large size display. The driving method of voltage type is similar to the traditional driving method for AMLCD and provides a voltage signal indicating grayscale level by a driving IC, and the voltage signal would be converted into a current signal of the drive transistor inside the pixel circuit, so that the OLED is driven to realize grayscale presenting the brightness. Therefore, the driving method of voltage type is used widely in the industry for its rapid driving speed and simply implementation, and is suitable to drive a large size panel, but the non-uniformity of TFTs and IR drop have to be compensated by other TFTs and capacitors designed additionally.

FIG. 7 is a traditional pixel circuit structure of a voltage driving type, comprising 2 TFTs and 1 capacitor (2T1C). A switching transistor T2 transfers the voltage on the data line to the gate of the driving transistor T1, and the driving transistor T1 converts the data voltage to a corresponding current for supplying for the OLED device. In a normal operation, the driving transistor operates in a saturation area and provides a constant current during a period for scanning one line. As shown in following equation (1), the driving current is expressed as:

$$I_{OLED} = \frac{1}{2}\mu_P \cdot Cox \cdot \frac{W}{L} \cdot (Vdata - ARVDD - V_{TH})^2 \quad (1)$$

Wherein $\mu_P$ denotes carrier mobility, $C_{OX}$ denotes a gate oxide layer capacitance, W/L denotes a ratio of width to length of the transistor, Vdata denotes a data voltage, ARVDD denotes a backboard power supply of the AMOLED shared by all pixel units, and $V_{th}$ denotes a threshold voltage of the transistor. It can be seen from the above equation, variation occurs in the current if the $V_{th}$ among different pixel units are different. Further, with the degradation of the OLED device, the brightness of the OLED would decrease even if a constant current is provided.

Document [1] discloses a pixel structure which is capable of compensating the non-uniformity of $V_{th}$ and IR drop, and the control timing thereof, as shown in FIG. 8. The structure in FIG. 8 may compensate effects due to the non-uniformity of $V_{th}$, IR drop and the degradation of OLED, but it is not suitable for the application with a large size panel since it is adopted in a driving method of current type.

It can be seen that, no effectual means for settling the previously-described problems, that is, how to compensate a luminance non-uniformity caused by the degradation of the OLED device, the non-uniformity of the threshold voltage in the TFTs and the voltage drop of the backboard power supply (IR drop), are not proposed in the prior art.

Reference Document

[1] "Current programming pixel circuit and data-driver design for active-matrix organic light-emitting diodes", Journal of the Society for Information Display 12 (2004) 227

SUMMARY

Embodiments of the present invention provide an improved pixel structure of an organic light emitting display device (OLED). The pixel structure enables a driving current flowing through the OLED device to be independent of the threshold voltage of a thin film transistor and the power supply of a backboard, and thus the problem of uneven luminance due to non-uniformity in the threshold voltage of the driving TFT and the voltage drop (IR drop) of the power supply of the backboard is eliminate.

According to one embodiment of the present invention, the pixel structure comprises first to fifth thin film transistors, a capacitor and an OLED device, wherein a drain of the first thin film transistor is connected to a negative power supply via the OLED device, a source of the first thin film transistor is connected to a drain of the third thin film transistor, and a source of the third thin film transistor is connected to a positive power supply; one end of the capacitor is connected to a third node N3 between the first and third thin film transistors, and the other end of the capacitor is connected to a second node N2 between a source of the second thin film transistor and a source of the fourth thin film transistor; a drain of the second thin film transistor is connected to a fourth node N4 between the first thin film transistor and the OLED device, a drain of the fourth thin film transistor is connected to a first node N1 between a drain of the fifth thin film transistor and a gate of the first thin film transistor, a source of the fifth thin film transistor is connected to a data line, and a gate of the fifth thin film transistor and a gate of the second thin film transistor are connected to a scan line; and a first control signal (EM) is provided to a gate of the third thin film transistor, and a second control signal (EMD) is provided to a gate of the fourth thin film transistor.

According to one embodiment of the present invention, for example, for the pixel structure, during a pre-charging period, a line scanning voltage on the scan line and the first control signal are at a low level, and the second control signal is at a high level; the fourth thin film transistor is turned off, the first, second, third and fifth thin film transistors are turned on, and a data voltage is transferred to the gate of the first thin film transistor via the fifth thin film transistor.

According to one embodiment of the present invention, for example, for the pixel structure, during a compensation period, a line scanning voltage on the scan line is at a low level, and the first control signal and the second control signal are at a high level; the third and fourth thin film transistors are turned off, the first, second and fifth thin film transistors are turned on, and a data voltage is transferred to the gate of the first thin film transistor via the fifth thin film transistor.

According to one embodiment of the present invention, for example, for the pixel structure, during a light emitting period, a line scanning voltage on the scan line is at a high level, and the first control signal and the second control signal are at the low level; the second and fifth thin film transistors are turned off, and the first, third and fourth thin film transistors are turned on.

According to one embodiment of the present invention, for example, for the pixel structure, during the pre-charging period and the compensation period, the signal on the data line (DATA) is an actual data voltage.

According to one embodiment of the present invention, for example, the first to fifth thin film transistors in the pixel structure are low temperature polycrystalline silicon thin film transistors.

According to one embodiment of the present invention, for example, a radio of width to length of the first thin film transistor in the pixel structure is set so as to compensate a brightness loss due to the degradation of the OLED device.

According to one embodiment of the present invention, a method for driving the above-described pixel structure is further provided, wherein the method comprises the following steps performed in a refresh process of each frame of an image: during a pre-charging period, the scan line and a first control signal (EM) are at a low level, and a second control signal (EMD) is at a high level, so that a fourth thin film transistor is turned off, and first, second, third and fifth thin film transistors are turned on; during a compensation period, the scan line is at a low level, and the first control signal (EM) and the second control signal (EMD) are at a high level, so that the third and fourth thin film transistors are turned off, and the first, second and fifth thin film transistors are turned on; and during a light emitting period, the scan line is at a high level, the first control signal (EM) and the second control signal (EMD) are at a low level, so that the second and fifth thin film transistors are turned off, and the first, and third and fourth thin film transistors are turned on.

With the above-described improved pixel structure of the AMOLED and driving method thereof, it cab effectively compensate the degradation of the OLED device, the non-uniformity in the threshold voltage of the driving TFT and the voltage drop of the power supply of the backboard, and thus the display effect and power consumption are further improved.

BRIEF DESCRIPTION OF THE DRAWINGS

Below will describe the embodiments of the present invention in details in connection with the accompanying drawings, wherein.

DETAILED DESCRIPTION

Figure 1A:
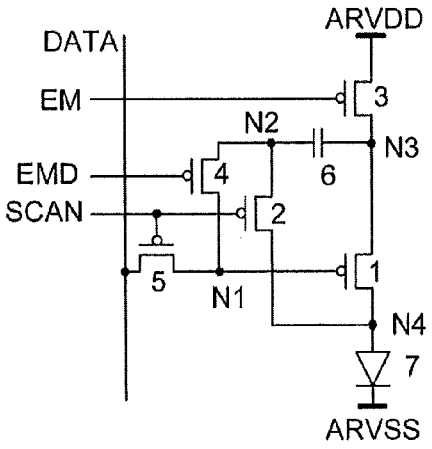
FIG. 1 a shows the pixel structure of the present invention.
FIG. 1*b* shows a control timing of the pixel structure shown in FIG. 1*a;*

As shown in FIG. 1*a*, the pixel circuit structure comprises P-type TFT transistors 1 to 5, a capacitor 6 and a OLED 7, wherein ARVDD and ARVSS are backboard direct current positive and negative level, respectively, DATA is a data voltage signal, SCAN is a line scanning voltage signal, EM and EMD are control signals. The pixel units in a same row share the SCAN and the EN, END control signals, and the pixel units in a same column share the DATA data voltage signal commonly. In the pixel circuit structure according to the present invention, a drain of the first thin film transistor 1 is connected to the negative level of the backboad via the OLED device, and a source of the first thin film transistor 1 is connected to a drain of the third thin film transistor 3; a source of the third thin film transistor 3 is connected to the positive level of the backboard; one end of the capacitor 6 is connected between the first thin film transistor 1 and the third thin film transistors 3 (i.e., the node N3), the other end of the capacitor 6 is connected to a source of the second thin film transistor 2 and a source of the fourth thin film transistor 4 (i.e., the node N2); a drain of the second thin film transistor 2 is connected to the drain of the first thin film transistor 1 and the OLED device 7 (i.e., the node N4); a drain of the fourth thin film transistor 4 is connected to a drain of the fifth thin film transistor 5 and a gate of the first thin film transistor 1 (i.e., the node N1), wherein a source of the fifth thin film transistor 5 is connected to a data line, a gate of the fifth thin film transistor 5 and a gate of the second thin film transistor 2 are connected to a scan line; a first control signal (EM) is provided to a gate of the third thin film transistor, and a second control signal (EMD) is provided to a gate of the fourth thin film transistor.

Figure 2A:
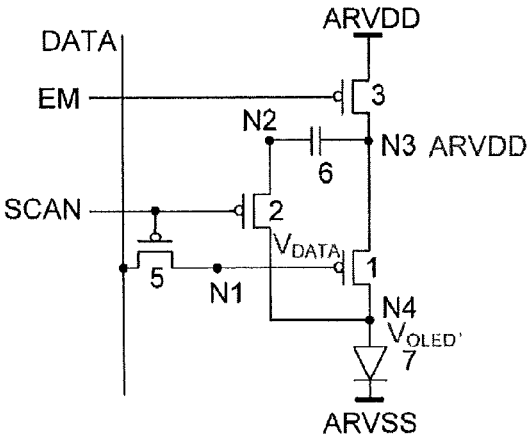
FIG. 2*a* to FIG. 2*c* show circuit states of the pixel structure in FIG. 1 during three different periods.
Figure 2B:
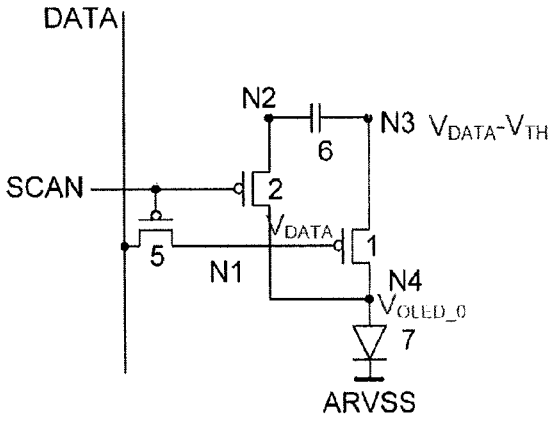

The second stage is the compensation stage, as shown in FIG. 2*b*. In this stage, the SCAN is at a low level, the EM and EMD are at a high level, and the Vdata is the actual data voltage. At this time, the transistors 3, 4 are turned off, and the transistors 1, 2 and 5 are turned on. The data voltage is transferred to the first node N1 via the transistor 5. Because the third node N3 is connected to the ARVDD via the transistor 3 before the EM changes to the high level, the initial voltage of the third node N3 at the moment when being turned off is the high level ARVDD; after the transistor 3 is turned off, the third node N3 is in a floating state and the transistor 1 is turned on, the third node N3 discharges to ARVSS, and therefore the potential at the third node N3 may drop gradually, until the transistor 1 locates in a critical cutoff area. At this time, the voltage at the third node N3 is VDATA-VTH, wherein the VTH is the threshold voltage of the transistor 1. In this course, the potential at the fourth node N4 may reduce with the current flowing through the transistor 1 and OLED decreasing, until the transistor 1 is turned off and the current is zero. At this time, the voltage at the fourth node N4 is $V_{OLED_0}$, that is, the threshold voltage of the OLED 7. Thus, charges of $(V_{DATA}-V_{TH}-V_{OLED\ 0})\cdot C$ are stored in the capacitor 6.

Figure 2C:
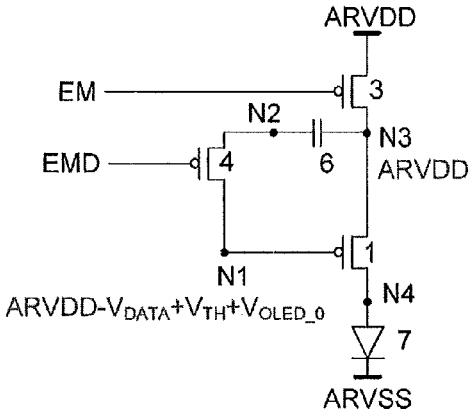

The third stage is light emitting stage, as shown in FIG. 2*c*. In this stage, the SCAN is at a high level, the EM, EMD are at a low level, and transistors 2, 5 are turned off, the transistors 1, 3, 4 are turned on at this time. The third node N3 is connected with ARVDD via the transistor 3, and its potential changes to ARVDD. Since the transistor 5 is turned off and no direct current path exists for the first node N1, the total amount of the charges at this node remains unchanged as compared with that in the second stage, as indicated by the following equation (2).

$$(V_{DATA}-V_{TH}-V_{OLED_0})\cdot C=(\mathrm{ARVDD}-V_{N1})\cdot C \tag{2}$$

By calculating, we can get $V_{N1}=\mathrm{ARVDD}-V_{DATA}+V_{TH}+V_{OLED_0}$ (3)

At this time, the current flowing through the transistor 1 is $$\begin{aligned} I_{OLED} &= \frac{1}{2}\cdot\mu_p\cdot Cox\cdot\frac{W}{L}\cdot(ARVDD-V_{DATA}+V_{TH}+V_{OLED_0}-ARVDD-V_{TH})^2 \\ &= \frac{1}{2}\cdot\mu_p\cdot Cox\cdot\frac{W}{L}\cdot[V_{OLED_0}-V_{DATA}]^2 \end{aligned} \tag{4}$$

Figure 1B:
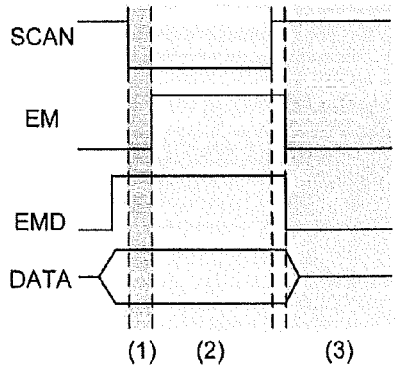

The operation process of the pixel circuit is divided into three stages, that is, pre-charging, compensation and light emitting, and the control signal timing thereof is as shown in FIG. 1*b*.

As shown in FIG. 2*a*, the first stage is the pre-charging stage. During this stage, the SCAN and EM are at a low level, the EMD is at a high level, and the DATA is at an actual data voltage. At this time, the transistor 4 is turned off, the transistors 1, 2, 3 and 5 are turned on, and a data voltage is transferred to the first node N1 on the gate of the transistor 1 via the transistor 5. The third node N3 is connected to ARVDD via the transistor 3 and its potential is ARVDD. The voltage at the fourth node N4 is ARVSS plus OLED driving voltage. Since the transistor 2 is turned on, here the capacitor 6 is equivalent to being connected between the third node N3 and the fourth node N4. The function of the pre-charging is to make the third node N3 reach a high potential in advance, so that the transistor 1 can establish an appropriate initial voltage during the compensation process in the second stage.

Figure 3:
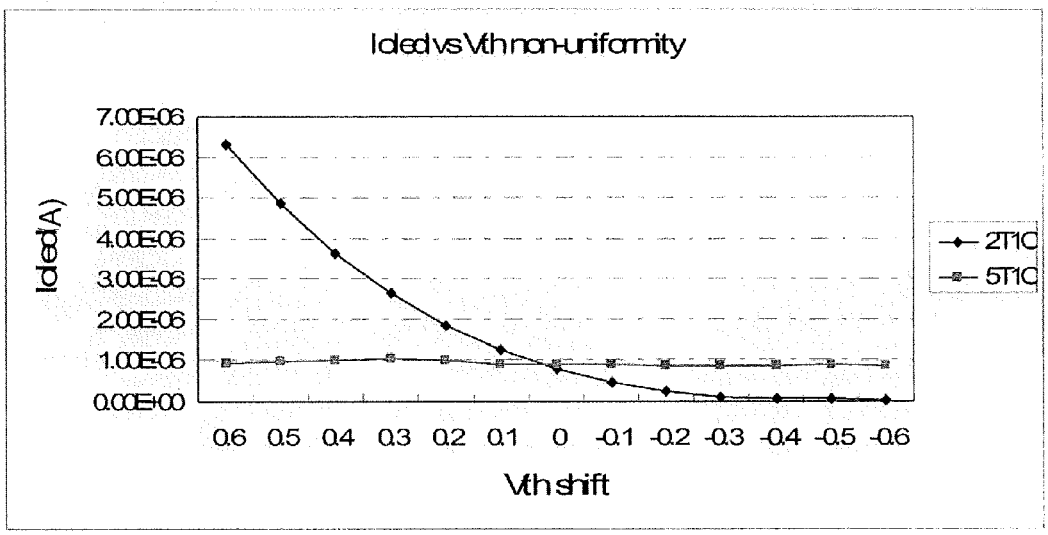
FIG. 3 shows a graph which is stimulated for uniformity compensation of the threshold voltage in the TFT driving transistor.
Figure 4:
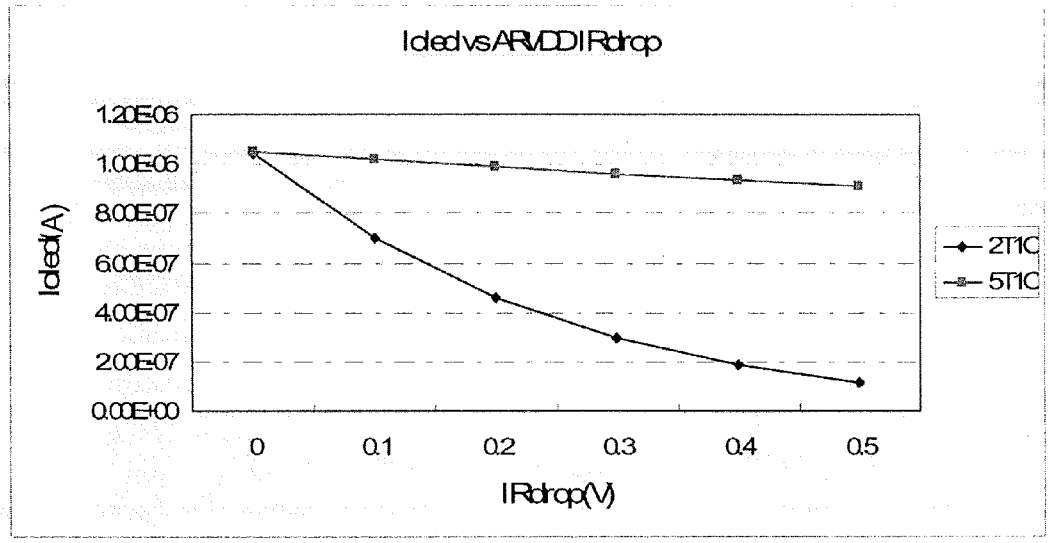
FIG. 4 shows a graph which is stimulated for compensation of the voltage drop of the power supply in the backboard.

As can be known by the above equation (4), the current is independent of the threshold voltage and ARVDD, therefore the affects of the non-uniformity in the threshold voltages and IR drop are substantially eliminated. FIG. 3 shows a simulation result of compensation for the non-uniformity in the threshold voltages. For a traditional structure without any compensation, a maximum drifting of the current may be up to above 1.8 times when the threshold voltage drifts ±0.6V, while in the structure of the present invention, the current fluctuation is smaller than 3%. FIG. 4 shows a simulation result of compensation for IR Drop. For a traditional structure without any compensation, a maximum drifting of the current is up to 81% when the voltage drop of ARVDD drifts ±0.5V, while in the structure of the present invention, the current fluctuation is smaller than 3.4%.

Meanwhile, the $I_{oled}$ current is correlated to the threshold voltage $V_{OLED_0}$ of the OLED, therefore it may compensate the brightness loss due to the degradation of the OLED. When the OLED degrades, the $V_{OLED—0}$ may increase gradually, and the efficiency of the light emitting may decrease, and it needs the first thin film transistor (drive transistor) 1 to provide larger current so as to maintain the same brightness. However, in an actual application, if Vdata<0 and Vdata<$V_{OLED_0}$, |Vdata−$V_{OLED_0}$| may increase as the $V_{OLED_0}$ increases, which makes an increasing of the $L_{oled}$ so as to compensate the brightness loss of the OLED.

It can be known from an expansion of Taylor series, if the threshold voltage drifts, the drifted threshold voltage may be expressed as $V'_{OLED_0}=V_{OLED_0}+\Delta V_{OLED_0}$, then a 1-order approximate expansion of the $I_{oled}$ with respect to the $\Delta V_{OLED_0}$ is as follows:

$$I_{OLED} = \frac{1}{2}\cdot\mu_p\cdot Cox\cdot\frac{W}{L}\cdot[V_{OLED_0}-V_{DATA}]^2 + \mu_p\cdot Cox\cdot\frac{W}{L}\cdot[V_{OLED_0}-V_{DATA}]\cdot\Delta V_{OLED_0} \quad (5)$$

Figure 5:
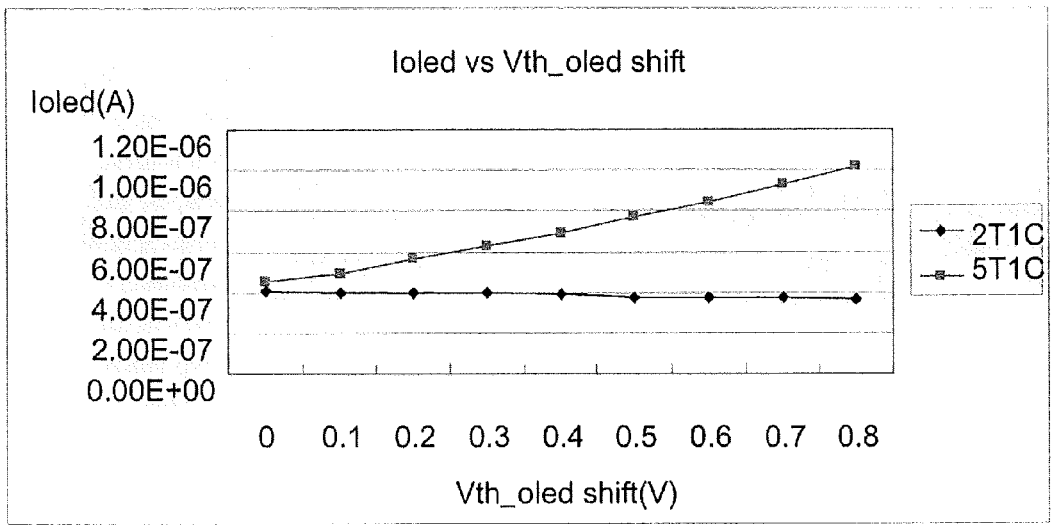
FIG. 5 shows a graph which is stimulated for compensation of the degradation of the OLED device.
Figure 6A:
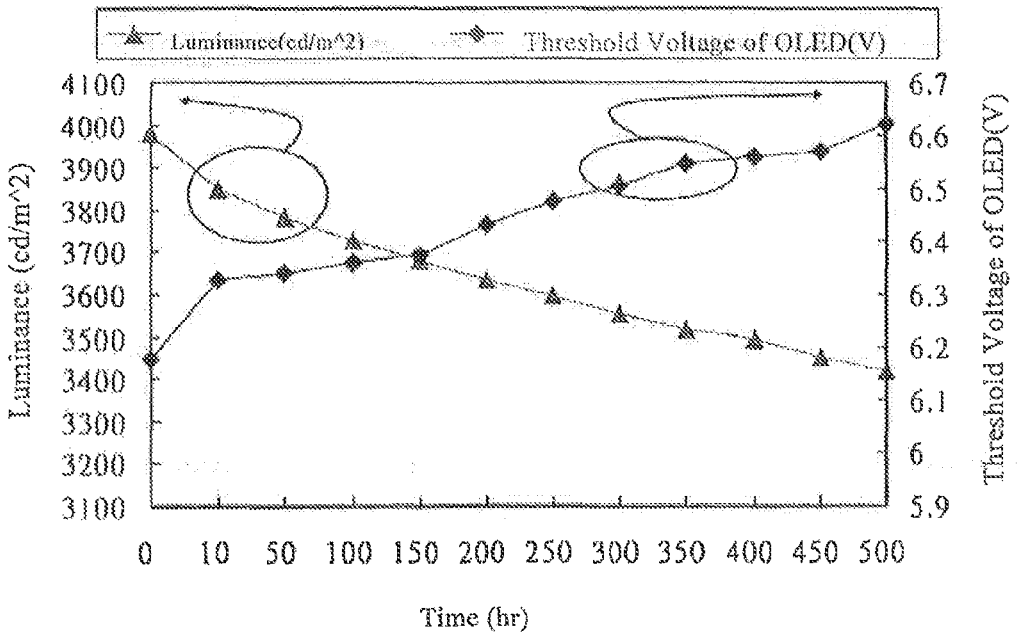
Fig. 6a (PRIOR ART)
FIGS. 6*a-c* show a graph indicating the variation in the brightness and threshold voltage of the OLED device as the usage time increases.
Figure 6B:
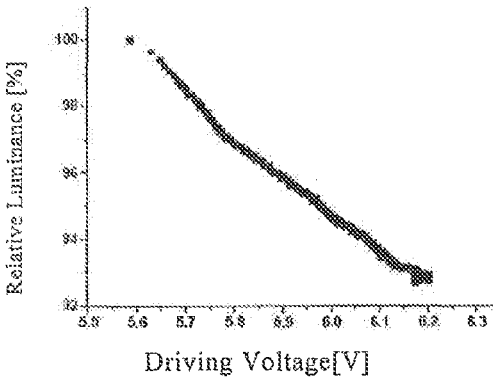
Fig. 6b (PRIOR ART)
Figure 6C:
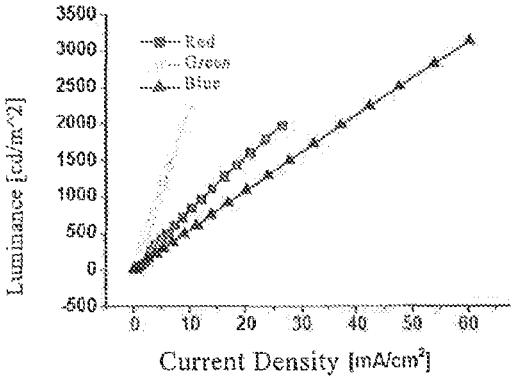
Fig. 6c (PRIOR ART)
Figure 7:
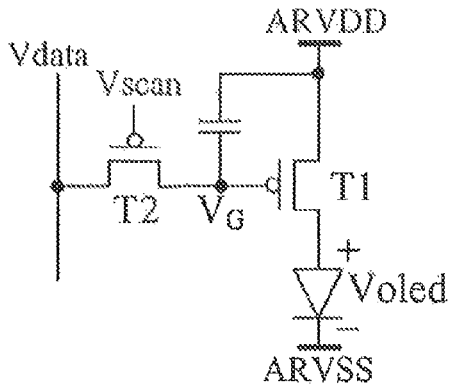
Fig. 7 (PRIOR ART)
FIG. 7 shows a circuit diagram of traditional pixel structure.
Figure 8A:
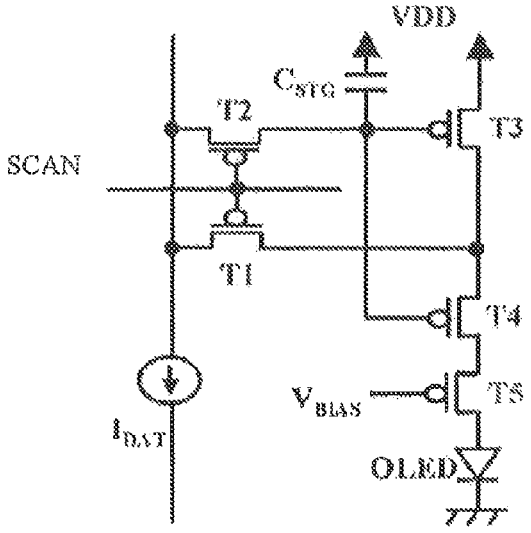
Fig. 8a (PRIOR ART)
FIGS. 8*a-b* shows pixel compensation circuit diagram and control timing diagram in the reference document 1.
Figure 8B:
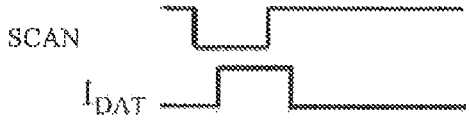
Fig. 8b (PRIOR ART)

The $I_{oled}$ is linear with the $\Delta V_{OLED_0}$, and therefore a slope of the $I_{oled}$ curve may be adjusted by setting a ratio of width to length of the first thin film transistor 1 according to the measurement result of the OLED degradation, so that the holed curve complements the brightness-$\Delta V_{OLED_0}$ curve to compensate the brightness loss due to the OLED degradation. FIG. 5 shows a simulation result of compensation for the OLED degradation. For a traditional structure without any compensation, the current tends to reduce tardily when the threshold voltage of the OLED drifts 0~0.8V, which would expedite the drop of the brightness, while in the structure of the present invention, the current may increase linearly synchronously as the threshold voltage of the OLED increases, which may effectively compensate the brightness loss of the OLED. In addition, adjusting the ratio of width to length of the first thin film transistor 1 may control a speed and range for increasing the current.

What is claimed is:

1. A pixel structure of an organic light emitting display device, comprising a first to a fifth thin film transistors, a capacitor and an organic light emitting display device, wherein a drain of the first thin film transistor is connected to a negative supply of a backboard via the organic light emitting display device, a source of the first thin film transistor is connected to a drain of the third thin film transistor, and a source of the third thin film transistor is connected to a positive power supply of the backboard; one end of the capacitor is connected between the first thin film transistor and third thin film transistor, and the other end of the capacitor is connected to a source of the second thin film transistor and a source of the fourth thin film transistor; a drain of the second thin film transistor is connected to a drain of the first thin film transistor and the organic light emitting display device; a drain of the fourth thin film transistor is connected to a drain of the fifth thin film transistor and a gate of the first thin film transistor, a source of the fifth thin film transistor is connected to a data line, and a gate of the fifth thin film transistor and a gate of the second thin film transistor are connected to a scan line; and a first control signal (EM) is provided to a gate of the third thin film transistor, and a second control signal (EMD) is provided to a gate of the fourth thin film transistor.

2. The pixel structure as claimed in claim 1, wherein during a pre-charging period, a line scanning voltage on the scan line and the first control signal are at a low level, and the second control signal is at a high level; the fourth thin film transistor is turned off, the first, second, third and fifth thin film transistors are turned on, and a data voltage is transferred to the gate of the first thin film transistor via the fifth thin film transistor.

3. The pixel structure as claimed in claim 2, wherein during a compensation period, the line scanning voltage on the scan line is at a low level, and the first control signal and the second control signal are at a high level; the third and fourth thin film transistors are turned off, the first, second and fifth thin film transistors are turned on, and a data voltage is transferred to the gate of the first thin film transistor via the fifth thin film transistor.

4. The pixel structure as claimed in claim 3, wherein during a light emitting period, the line scanning voltage on the scan line is at a high level, and the first control signal and the second control signal are at low level; the second and fifth thin film transistors are turned off, and the first, third and fourth thin film transistors are turned on.

5. The pixel structure as claimed in claim 3, wherein during the pre-charging period and the compensation period, a signal on the data line (DATA) is an actual data voltage.

6. The pixel structure as claimed in claim 1, wherein the first to fifth thin film transistors are low temperature polycrystalline silicon thin film transistors.

7. The pixel structure as claimed in claim 1, wherein a ratio of width to length of the first thin film transistor is set so as to compensate a brightness loss due to the degradation of the organic light emitting display device.

8. A method for driving the pixel structure as claimed in claim 1, wherein the method comprises the following steps performed in a refresh process of each frame of an image:

during a pre-charging period, the scan line and a first control signal (EM) are at a low level, a second control signal (EMD) is at a high level, so that the fourth thin film transistor is turned off, and the first, second, third and fifth thin film transistors are turned on;

during a compensation period, the scan line is at a low level, the first control signal (EM) and the second control signal (EMD) are at a high level, so that the third and fourth thin film transistors are turned off, and the first, second and fifth thin film transistors are turned on; and during a light emitting period, the scan line is at a high level, the first control signal (EM) and the second control signal (EMD) are at a low level, so that the second and fifth thin film transistors are turned off, and the first, third and fourth thin film transistors are turned on.

9. The method as claimed in claim 8, wherein during the pre-charging period and the compensation period, a signal on the data line (DATA) is an actual data voltage.

* * * * *